United States Patent [19]

Sutton

[11] Patent Number: 5,064,292

[45] Date of Patent: Nov. 12, 1991

[54] METHOD AND APPARATUS FOR PREPARING AND USING A CEMENT SLURRY

[76] Inventor: John S. Sutton, P.O. Box 677, Keller, Tex. 76248

[21] Appl. No.: 409,162

[22] Filed: Sep. 19, 1989

[51] Int. Cl.[5] ..... B28C 5/20

[52] U.S. Cl. ..... 366/2; 241/171; 366/59

[58] Field of Search ..... 366/2, 3, 5, 6, 10, 366/40, 42, 43, 44, 50, 54, 62, 63, 220, 224, 225, 57, 59; 241/171, 172

[56] References Cited

U.S. PATENT DOCUMENTS

| | | | |
|---|---|---|---|
| 2,922,586 | 1/1960 | Hardinge | 241/172 |
| 4,018,567 | 4/1977 | Point | 241/172 |
| 4,100,617 | 7/1978 | Hoopman | 366/50 |
| 4,730,934 | 3/1988 | Schwing | 366/40 |

FOREIGN PATENT DOCUMENTS

| | | | |
|---|---|---|---|
| 2359854 | 6/1975 | Fed. Rep. of Germany | 366/50 |

*Primary Examiner*—Robert W. Jenkins

*Attorney, Agent, or Firm*—T. D. Copeland

[57] ABSTRACT

This invention relates to a method of preparing, transporting, disposing and distributing a load of cement slurry, especially for highway and similar construction work. This method is particularly adapted to be used to reconstruct old road beds, which already have a surface material thereon, but which surface has deteriorated to such an extent that a new road surface is required. This method and apparatus provide a greatly improved safety means to the construction industry, which heretofore has relied on the "dry cement powder" process, which generates a toxic dust cloud that is harmful to humans, animals and vegetation, to obtain the widely used "cement treated base" for construction or renovation of roads, streets and highways.

11 Claims, 2 Drawing Sheets

METHOD AND APPARATUS FOR PREPARING AND USING A CEMENT SLURRY

I. BACKGROUND OF THE INVENTION

1. Field of Use

This invention will be used in the construction industry, and more particularly in highway and road construction employing a technique known as "Cement Treated Base" or CTB preparation. This CTB preparation method is applicable to both old and new highway and road construction.

2. Prior Art

A current method employed by road builders to prepare a road bed for subsequent topping with concrete or asphalt, includes the initial step of pulverizing the base materials or old road surface, grading the road bed and compacting the base material. When using the "Cement Treated Base" procedure, the next operation includes spraying the road bed soil mixture with dry powered cement, and then adding water to obtain the proper moisture content to the dry cement on the roadbed. This mixture would then be mixed into the compacted road bed/soil mixture base. This base would then be graded, shaped, and compacted to desired height and density, before chemical hydration (and setting of the CTB) occurs. The now in place CTB would then be kept damp for at least six hours.

Chemical hydration is the conversion of liquid water to crystalline water, and provides a strength producing mechanism when concrete sets. Certain chemical mixtures are now available to retard chemical hydration, but still, several problems are encountered in their use in delayed hydration, for example:

a. Variable water to hydration retarder mixture ratio results in inconsistent road bed strength.

b. Nodules of dry cement are not consistently mixed with the applied water and base material, resulting in zones of accelerated chemical hydration that produces localized weaknesses in the road bed.

c. Use of chemical hydration retarders that extend the hydration time, such that water in the mixture evaporates before adequate hydration occurs, reduces road bed strength.

Because of the above problems, the use of retarders, per se, has not resulted in a satisfactory alternate to the CTB method.

In the current conventional CTB procedure, as described hereinbefore, the spraying of dry powered cement over the road bed results in the formation of clouds of toxic, alkaline, high silica dust that are hazardous to the skin, lungs and eyes of humans and animals, and that are damaging to surrounding vegetation, and further create an on going clean-up problem, in addition to being extremely wasteful and expensive.

Many patents have been issued relating to the art of retardation of chemical hydration. Typical of these is U.S. Pat. No. 3,053,673, issued on Sept. 11, 1962, to Wayne A. Walker, and assigned to Halliburton Company, Inc. However, the use of chemical retarders without the use of the method and apparatus of the invention described herein, has not produced the desired results of this invention.

II. SUMMARY OF THE INVENTION

The instant invention provides solutions to the foregoing and other problems, thereby improving the quality of cement treated base road beds, as well as eliminating the serious health and environmental hazards of the toxic dust clouds formed when using the dry powdered cement. The Environmental Protection Agency (EPA) has recognized this as a problem that needs to be corrected, and this invention will make this correction.

The problems of the conventional CTB are resolved by the Applicant's steps of thoroughly mixing and dispersing cement and retarder agent throughout the wet cement slurry, by using multiple mobile, heavy objects (which may be balls) within the cement slurry while it is being transported in a cement mixer truck with a rotating mixer drum. These loose heavy objects are free to tumble at random within the rotating slurry, crushing dry nudules of cement, and thoroughly mixing the cement and retarder solution. The loose heavy tumbling balls within the cement mixer drum rotate and tumble while the slurry is being transported and also when it is being discharged into a prepared road bed.

A principal object of this invention is to provide a means and method to be used for highway construction employing the "Cement Treated Base" process, but where the customary dry powdered cement spray is replaced by the use of a wet cement slurry.

A further object of this invention is to employ a plurality of loose and heavy objects bouncing freely off the inside walls and blades of the rotating mixing drum, while the drum and cement slurry are being transported, so that the heavy objects may crush dry and partly wetted nodules of cement and eliminate sites of accelerated hydration.

A still further object is to provide a means to maintain the loose objects within the cement slurry while the slurry is being transported in the revolving drum of a cement mixer truck.

An additional object is to provide a means of deliberately retaining the loose objects within the rotating mixing drum while the cement slurry is being discharged at the job site.

A further object is to provide a method and means for using available ligno/sulfonate, water dispersing, chemical hydration retarders to extend the available time to prepare and transport a cement slurry to a distant job site, and prepare and mix the slurry with soil and set in place before significant chemical hydration occurs within the cement/soil mixture.

And a still further object is to provide a method and means for using available ligno/sulfonate, water reducing, chemical hydration retarders in a method for extending the time before chemical hydration occurs, so that a cement slurry may be prepared at a distant cement plant and be transported and dispersed onto a job site road bed that is several hours travel time more distant than possible when using conventional methods and apparatus.

A further object of this invention is to provide a cement mixer having a removably attached spreader at its aft end for spreading discharged cement slurry onto a job site in a manner to be compatible with the cement treated base highway construction.

III. BRIEF DESCRIPTION OF THE DRAWING

IV. DESCRIPTION OF THE PREFERRED EMBODIMENTS

Figure 1:
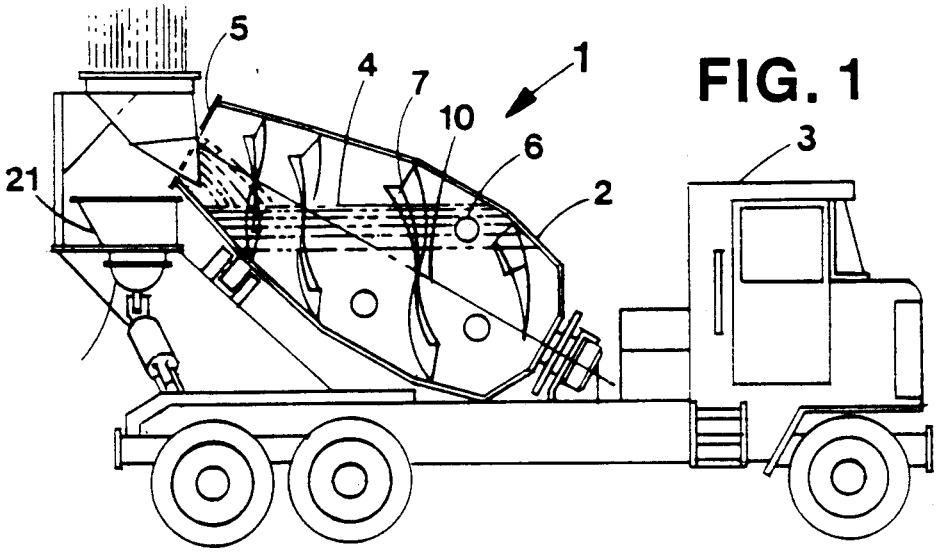
FIG. 1 is a view of a conventional rotating cement mixer drum shown in cross section, assembled onto a truck, but into which drum have been placed a plurality of random objects to assist in preparation of cement slurry for transporting to a distant job site.

In FIG. 1 it will be seen that the method of this invention may be practiced in an apparatus 1, obtained by the addition of a plurality of unencumbered loose and heavy objects 6 into the rotating drum 2, when the cement slurry 4 is loaded through the open end 5. During loading, drum 2 is rotated in a direction that causes the cement slurry 4 to be pumped into the bottom of drum 2, and to mix randomly with the loose and heavy objects 6, which may, for example, be from 2" to 6" stainless or other steel balls, or may be of a variety of materials and shapes, so long as the minimum dimensions of the objects exceed the maximum dimensions of the openings in retainer 11, to be described hereafter.

While the cement slurry 4 is being transported to a job site, drum 2 is continuously rotated in the same direction as when loading to prevent the cement slurry 4 from exiting through the opening 5. This same rotation also causes the plurality of loose and heavy objects 6 to travel within the rotating drum 2 in a churning motion and to randomly bounce against the walls and spiral blades 7 crushing nodules of dry cement within slurry 4. This action provides a thoroughly mixed and well dispersed cement slurry 4 free of dry or partially dry cement nodules, which are sites of chemical hydration, and potentially cause accelerated hydration phenomena within the rotating drum. The resulting slurry is a finer quality cement mixture to be used with the cement treated base method of roadway construction.

Figure 2:
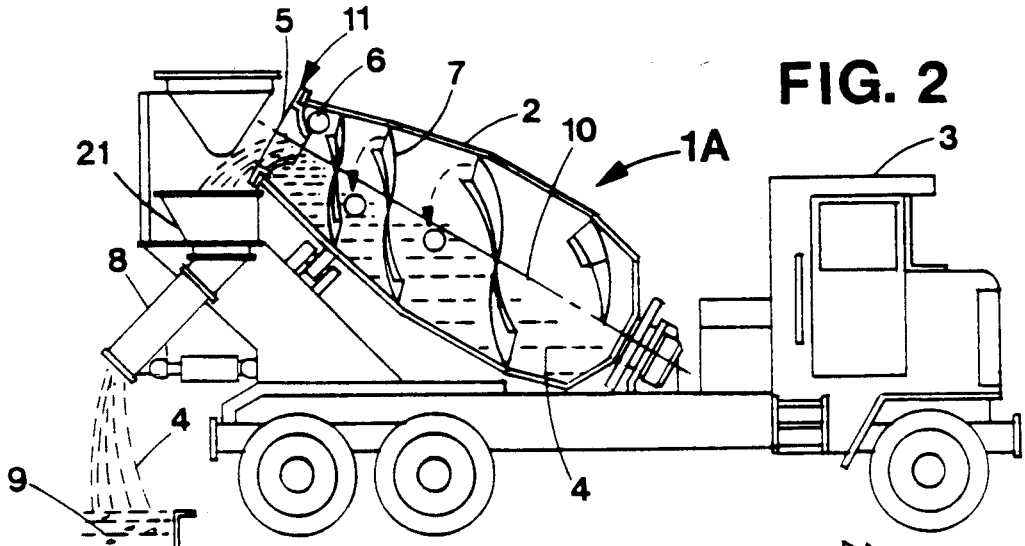
FIG. 2 is a cross section view of a modified apparatus of FIG. 1, shown discharging cement slurry at a job site.

FIG. 2 illustrates the apparatus 1A of this invention, and the means employed to retain the loose and heavy objects 6 within the drum 2 when the drum is rotating in a direction to discharge the cement slurry 4 at the job site 9. Upon arrival at the job site, rotation of the drum 2 is reversed, thereby causing cement slurry 4 to be transported upward by the blades 7 and out thru retaining means 11, and out the open end 5 of drum 2, and thence into funnel 21 and chute 8, and onto a road bed 9. The loose and heavy objects 6 are likewise transported upward toward the open end 5, where they encounter retainer 11, and are diverted back into the cement slurry 4 and thus fall back toward the bottom of the drum 2. At this point, the balls 6 are again picked up by the blades 7 and returned upward until they again hit the retainer 11, and fall back once more. The openings A in retainer 11, are smaller than the smallest dimension of the objects 6, so that the objects remain in the mixer drum at all times, until the retainer 11 is unbolted from the drum at 22, and removed from the open end 5 of the mixer drum 2.

Figure 4:
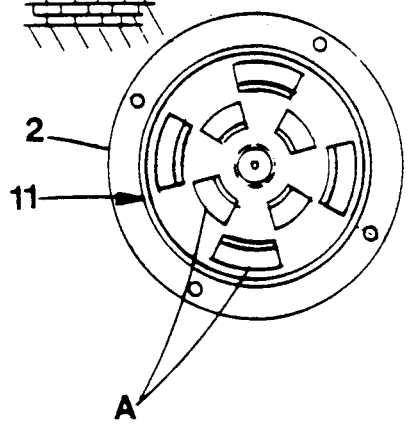
FIG. 4 is a cross section taken along the lines 4—4 of FIG. 3.
Figure 3:
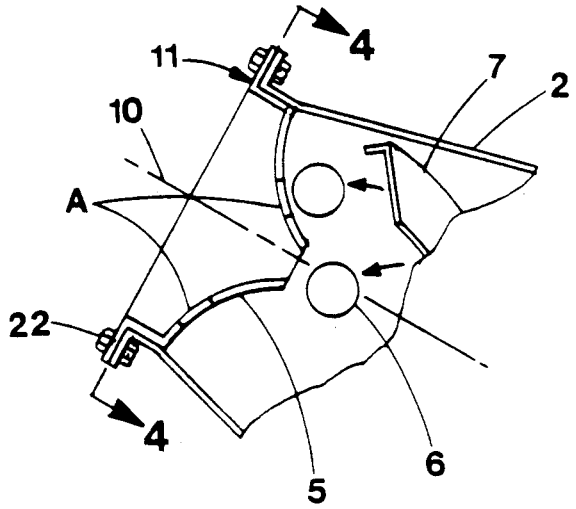
FIG. 3 is an enlarged fragmentary section view of the discharge end of the rotating drum of FIG. 2, with a special retainer thereon.

This activity of the loose and heavy objects 6 is repeated continually throughout the period of discharging the cement slurry 4, continuing to shear through the slurry 4, crushing dry nodules of cement that may remain, thereby providing a mixture of superior properties for the purposes of this invention. Apertures A in the retainer 11, as seen in FIG. 4, may be of a variety of configurations, including a large mesh screen, seine, or grill, so long as none of the openings will permit passage of any of the random objects 6, whose optimum size is from approximately 2½" to 3" in diameter.

Figure 5:
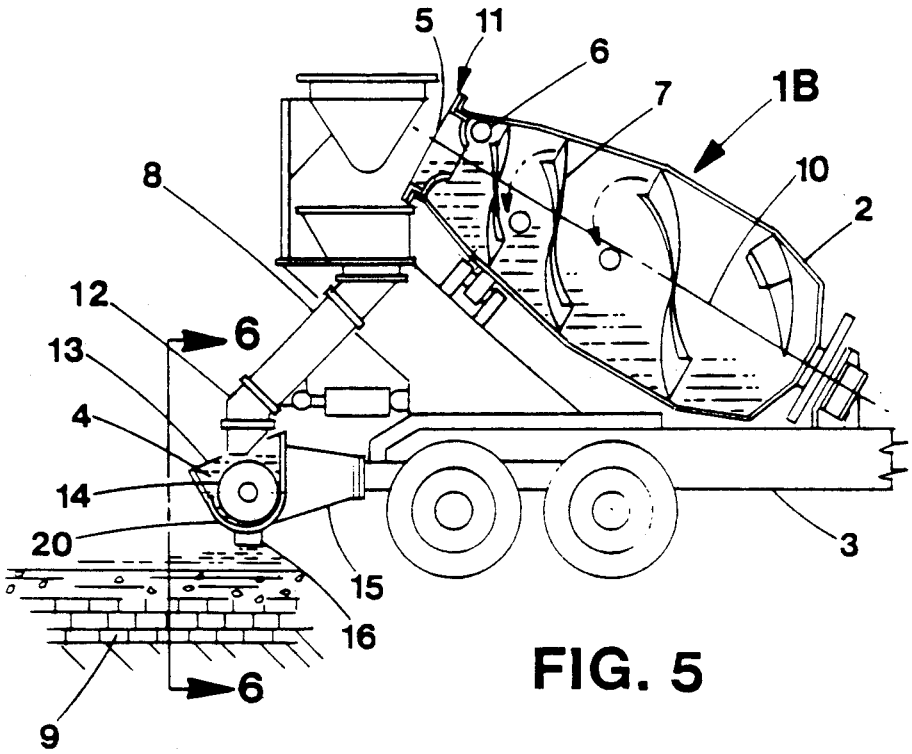
FIG. 5 is a view similar to FIG. 2, showing the addition of a cement slurry spreader for use in this invention.

FIG. 5 shows the apparatus 1B which includes both the retainer 11, to prevent the loose heavy objects 6 from exiting the drum 2 during the pouring cycle, and the slurry spreader 13, which causes the wet cement slury to be distributed evenly over the width of the road bed during discharge of the load from drum 2.

Figure 6:
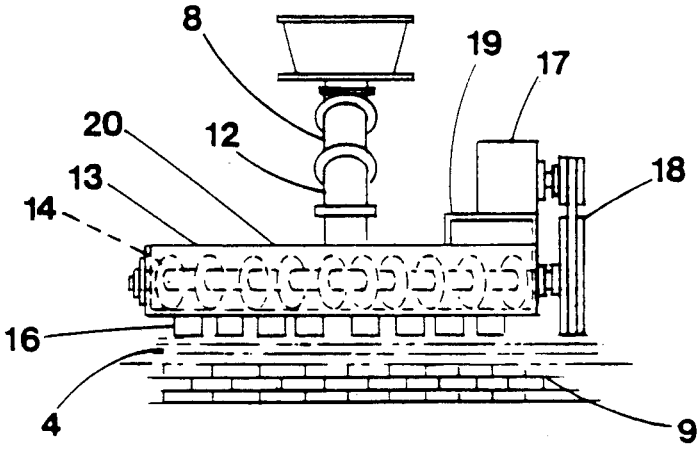
FIG. 6 is a view taken along the lines 6—6 of FIG. 5, with the rearmost side removed for clarity of illustration.

The slurry spreader 13 is secured to the cement mixer truck 3 by removable means 15, which supports and positions the trough or slurry reservoir 20 just beyond the discharge end of drum 2. A discharge elbow 12 is attached to chute 8, which is attached at its top end under funnel 21, and is positioned at its lower end centrally over slurry reservoir 20, as shown in FIGS. 5 and 6. FIG. 6 more clearly illustrates the power source 17, mounted to support 19, which is rigidly secured to the slurry reservoir 20. Power source 17 is energized to drive a conveyor screw 14 by means 18 to move wet slurry in both directions from the discharge coming from chute 8 and elbow 12. Means 18 may be alternatively a combination of Vee belts and pulleys, chain and sprockets, or mating gears, or equivalents. When it is desired to spread this cement slurry 4, the rotation of mixer drum 2 is reversed, thereby causing cement slurry 4 to be transported upward on the surface of blades 7, through the ball trap or retainer 11, out the open 5, through funnel 21 and into chute 8, through discharge elbow 12 and its attached guard 12A, and into the reservoir 20 of slurry spreader 13. The slurry is conveyed uniformly towards each end of the reservoir 20, while being uniformly distributed through exit nozzles 16 onto the road bed of job site 9, and to a width minimally equal to that of the cement mixer truck 3, which then moves longitudinally along the road bed to provide continuous additional layers of placed cement onto the job site 9 for subsequent grading and shaping to provide the base or in-place road bed for subsequent topping with concrete or asphalt.

In highway and road construction it has been found that the relatively new procedure, "Cement Treated Base" provides an excellent road bed, onto which is later added a topping. This procedure is particularly useful where the job site is an old and deteriorating roadway in need of conversion to a modern and useful road or highway. When using this new CTB procedure, the old roadway is broken and pulverized on the spot, and thereby forms the job site or road bed for the construction of the new highway.

The pulverized material may include asphalt, soil, concrete, crushed rock, etc., and the procedure for reclaiming an old roadbed or preparing a new one, using the current CTB procedure is basically as follows:

a. Pulverize base material of new or old road bed/surface.

b. Grade and shape to plan.

c. Compact the soil and road bed mixture (optional here).

d. Spray dry powdered cement thru nozzles onto road bed.

e. Mix dry cement thoroughly into road bed f. Add water to form proper moisture content.

g. Mix thoroughly into soil/road bed mixture.

h. Compact the cement/soil/road bed mixture to proper density.

i. Grade and shape to plan (level to desired height).

j. Maintain the now in place road bed damp for at least 6 hrs.

A conventional machine used for spreading dry cement has long laterally extending arms of perforated pipe from which the dry powdered cement is sprayed onto the newly formed road bed. During this operation, a large cloud of toxic alkaline, high silica content dust is formed and carried by the prevailing winds into unprotected surrounding areas, causing hazardous conditions for the existing natural environment and humans and animals alike, until the mixture is wetted down with water. By this time, however, the damage to human lungs, eyes and skin, and to vegetation has already taken place.

The present invention overcomes these adverse conditions of the presently employed cement treated base (CTB) procedures by providing an apparatus and method whereby a wet cement slurry is now available to be used directly at the job site, eliminating the need of the harmful dry powdered cement mixture. Construction contractors have not used wet cement slurries because of the practice of over dosing the cement slurry with chemical hydration retarders in order to avoid the phenomena of self accelerated hydration, which in turn delays the chemical hydration in the compacted cement/soil road bed. This evaporation of necessary water reduces chemical hydration in the compacted cement/soil road bed, thereby reducing the strength of the finished road bed.

One example of the process of the present invention, for a typical nine (9) cubic yard volume cement mixing drum is:

1. Load the mixer drum with approximately 10 dry tons of Type A Portland cement.

2. Load approximately 25 steel balls of approximately 3" in diameter (approx. 5.5#/ea.).

3. Install a ball trap on the discharge opening of the drum.

4. Pour approximately 940 gallons of water and approximately 10 pounds of powdered water dispersing (alternately water reducing) chemical hydration retarder (Haliburton's HR-12 or equivalent) to produce the cement slurry.

5. Rotate the mixer drum, after steps 1–3 are completed, and during step 4, in a direction to confine the slurry and balls in the drum, to cause the balls to crush any dry or partially wetted nodules, while travelling to the job site.

6. At the job site, attach the slurry spreader means, and position the slurry discharge chute centrally over spreader.

7. Activate the slurry spreader power source.

8. Reverse direction of rotation of mixer drum, to discharge cement slurry into slurry spreader for even spreading onto the road bed, while mixer truck slowly traverses the road bed.

9. Pulverize old road or new ground site.

10. Mix road bed and slurry with traveler mixer.

11. Compact the soil mixture to proper height and density.

12. Grade to plan and level road bed to desired height.

13. Wet down with water truck to keep damp for 6 hrs. minimum.

The instant invention improves on the conventional cement treated base procedure by completely eliminating the exposure of people and the environment to the harmful dry cement powder, by providing both a method and means for using a wet cement slurry to accomplish the same or better result. One of the reasons that contractors have not heretofore used a cement slurry for this purpose, was that a load of cement travelling in a conventional concrete mixer truck would set up and harden in approximately one hour and forty-five minutes. This did not give the operators sufficient time to discharge the mix at the job site and spread over the surface, unless the cement batch plant that loaded the mixer was virtually at the job site, which is hardly ever the case. But using the Applicant's method and apparatus, the batch plant may be virtually any distance away, since the hardening time for his slurry may be up to twenty-four hours. A typical job site may be three hours from the batch plant where the mixer is loaded, and after pouring cement slurry mix onto the road bed, the operators will need to work the mix into the crushed materials bed, and to spread it evenly before it sets up. The available time becomes ten or twelve hours, rather than the present one hour and forty-five minutes, which allows no time for working the cement after pouring.

This invention contrasts with present practices of using cement slurries within a rotating drum having high cement concentrations and employing ligno poly sachride based retarders, which can easily result in the phenomena of self induced chemical hydration. This phenomena is a sequence of repeating events within the cement slurry, and is initiated by nodules of dry, or partially wetted cement whereas these nodules are sites of accelerated chemical hydration causing the surrounding volume of cement to experience a significant temperature rise, which subsequently accelerates chemical hydration in more of the surrounding cement slurry, further increasing the slurry's temperature, and continuing to repeat until the slurry's initial set is reached. A process which can be culminated in as little as thirty minutes after the first noticeable viscosity increase. Within an additional thirty minutes, the temperature of the set slurry can exceed 212 degrees F. The results of this phenomena are catastrophic to the owner of the cement mixing truck, either in terms of labor costs to reclaim the mixing drum, or the loss of an irreparable mixing drum.

Modifications and variations of this invention are possible in light of the above teachings. It is therefore understood that, within the spirit and scope of the appended claims, the invention may be practiced otherwise than as specifically described.

What is claimed:

1. In an apparatus for preparing and using a cement and chemical hydration retarder slurry with a cement mixing drum having internal means for moving said slurry within and subsequently out of said drum, a plurality of small heavy objects in said slurry that are adapted to rotate randomly within said drum and to crush dry nodules of cement within said slurry, wherein said drum includes a discharge end, the improvement comprising: a heavy object rejecting retainer installed at said discharge end and adapted to permit passage of said cement slurry therethrough, and further adapted to prevent passage of said heavy objects therethrough, while reversing the direction of travel of said heavy objects back into the cement slurry.

2. A apparatus as in claim 1, wherein said retainer comprises structured openings therethrough to permit passage of said slurry and prevent passage of said heavy objects.

3. An apparatus as in claim 2, wherein said heavy objects are ferrous balls, and said structured openings have a maximum dimension that is less than the minimum diameter of said balls.

4. An apparatus as in claim 3, wherein said structured openings comprise a grid, and wherein said heavy objects comprise irregular sized and shaped chunks of heavy material.

5. An apparatus as in claim 4, wherein said material is steel.

6. An apparatus as in claim 5, wherein said retainer comprises a plurality of open windows of a size to permit passage of said slurry and to prevent passage of said heavy objects therethrough.

7. An apparatus as in claim 1, wherein said retainer is removably attached to said mixing drum.

8. A method of preparing and using a cement/retarder slurry, with a cement mixer truck having a drum that rotates and mixes the cement/retarder slurry within the drum, comprising the steps of:

a. loading the mixer drum with the amount of dry cement and hydration retarder agent and water necessary to produce the desired amount of cement/retarder slurry, b. loading a plurality of small heavy objects into said drum, c. attaching a retainer to the discharge end of said mixer drum to permit exit of said slurry but prevent exit of said objects from said drum, d. rotating said drum in a direction to retain said slurry and bounce said heavy objects to crush cement/retarder nodules therein.

9. A method as in claim 8, wherein said plurality of said heavy objects is within the range of two to approximately fifty.

10. A method as in claim 9, wherein said heavy objects are balls having a diameter range of from two to approximately six inches.

11. A method of preparing and using a cement/retarder slurry, with a cement mixer truck having a drum that rotates and mixes the cement/retarder slurry within the drum, comprising the steps of:

a. loading the mixer drum with the amount of dry cement and hydration retarder agent and water necessary to produce the desired amount of cement/retarder slurry, b. loading a plurality of small heavy objects into said drum, c. rotating said drum in a direction to retain said slurry and bounce said heavy objects to crush cement/retarder nodules therein, d. subsequently rotating said drum in a direction to discharge said slurry at a job site and removing said heavy objects from said discharging slurry at a job site, and e. removing said heavy objects from said discharging slurry.

* * * * *